US008741129B2

(12) United States Patent
Brown et al.

(10) Patent No.: US 8,741,129 B2
(45) Date of Patent: Jun. 3, 2014

(54) USE OF LOW BOILING POINT AROMATIC SOLVENT IN HYDROPROCESSING HEAVY HYDROCARBONS

(75) Inventors: Stephen Harold Brown, Annandale, NJ (US); Teh C. Ho, Bridgewater, NJ (US); Jane Chi-Ya Cheng, Bridgewater, NJ (US); Hyung Suk Woo, Easton, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 13/597,582

(22) Filed: Aug. 29, 2012

(65) Prior Publication Data

US 2013/0081978 A1 Apr. 4, 2013

Related U.S. Application Data

(60) Provisional application No. 61/529,565, filed on Aug. 31, 2011.

(51) Int. Cl.

| | |
|---|---|
| ***C10G 45/00*** | (2006.01) |
| ***C10G 47/00*** | (2006.01) |
| ***C10G 45/02*** | (2006.01) |
| *C10G 45/32* | (2006.01) |
| *C10G 45/44* | (2006.01) |

(52) U.S. Cl.

CPC ..... *C10G 45/00* (2013.01); *C10G 45/02* (2013.01); *C10G 45/32* (2013.01); *C10G 45/44* (2013.01); *C10G 47/00* (2013.01); *C10G 2300/44* (2013.01)

USPC .... 208/108; 208/208 R; 208/213; 208/251 H; 208/254 H

(58) Field of Classification Search

USPC ..... 208/108

See application file for complete search history.

(56) References Cited

U.S. PATENT DOCUMENTS

| | | | | |
|---|---|---|---|---|
| 4,548,709 | A * | 10/1985 | Bowes et al. | 208/213 |
| 4,619,759 | A | 10/1986 | Myers et al. | |
| 5,233,112 | A * | 8/1993 | Marler et al. | 585/467 |
| 5,389,230 | A * | 2/1995 | Veluswamy | 208/68 |
| 2010/0065472 | A1 * | 3/2010 | Chabot | 208/57 |

OTHER PUBLICATIONS o-Xylene, MSDS ACC# 17180, Fischer Scientific, Feb. 5, 2002.*
Benzene, MSDS ACC# 02610, Fischer Scientific, Nov. 9, 2008.*
Toluene, MSDS No. BDH-180, Honeywell, Dec. 21, 2005.*
The International Search Report and Written Opinion of PCT/US2012/052994 dated Mar. 11, 2013.
"Standard Test Method for Distillation of Petroleum Products at Atmospheric Pressure", Annual Book of ASTM Standards, 2007, pp. 18-45, vol. 5.01.

* cited by examiner

*Primary Examiner* — Randy Boyer
*Assistant Examiner* — Brandi M Doyle
(74) *Attorney, Agent, or Firm* — Chad A. Guice

(57) ABSTRACT

This invention is directed to a process for producing a hydroprocessed product. The invention is particularly advantageous in that substantially less hydrogen is absorbed during the process relative to conventional hydroprocessing methods. This benefit is achieved by using a particular solvent as a co-feed component. In particular, the solvent component contains at least one single ring aromatic compound and has a relatively low boiling point range compared to the heavy hydrocarbon oil component used as another co-feed component.

14 Claims, 3 Drawing Sheets

USE OF LOW BOILING POINT AROMATIC SOLVENT IN HYDROPROCESSING HEAVY HYDROCARBONS

CROSS-REFERENCE TO RELATED APPLICATIONS

This application claims priority to U.S. Provisional Application Ser. No. 61/529,565 filed Aug. 31, 2011, herein incorporated by reference in its entirety.

FIELD OF THE INVENTION

This invention is directed to a process for producing a hydroprocessed product from residua or heavy hydrocarbon feeds. More specifically, this invention is directed to a process for producing a hydroprocessed product from a heavy hydrocarbon oil, using a relatively low boiling point solvent that contains at least one single-ring aromatic compound.

BACKGROUND

Crude oil is typically distilled to produce a variety of components that can be used directly as fuels or that are used as feedstocks for further processing or upgrading. In what is known as atmospheric distillation, a heavy residuum is produced typically that has an initial boiling point of about 650° F. (343° C.). This residuum is typically referred to as atmospheric residuum or as an atmospheric residuum fraction.

Atmospheric residuum fractions tend to collect a relatively high quantity of various metals, sulfur components and nitrogen components relative to the lighter distillation fractions as a result of the distillation process. Because these metal, sulfur and nitrogen components are relatively undesirable in various fuels, they are typically removed by various catalytic hydroprocessing techniques.

In some instances, the atmospheric residuum is further distilled under vacuum, i.e., at a pressure below atmospheric pressure, to recover additional distillation fractions. At vacuum conditions, additional lighter fractions can be recovered without adding to various problems encountered in atmospheric distillation such as coking of the heavy fraction components. The heavy residuum recovered in vacuum distillation of the atmospheric residuum is typically referred to as vacuum residuum or a vacuum residuum fraction, and typically has an initial boiling point of about 1050° F. (566° C.). This vacuum residuum is generally higher in metals, sulfur components and nitrogen components than atmospheric residuum, and as was the case with atmospheric residuum, removal of these components is typically carried out by catalytic hydroprocessing.

Catalytic hydroprocessing of atmospheric and vacuum residua is carried out in the presence of hydrogen, using a hydroprocessing catalyst. In some processes, hydroprocessing of residua is carried out by adding a diluent or solvent.

U.S. Pat. No. 3,617,525 discloses a process for removing sulfur from a hydrocarbon fraction having a boiling point above about 650° F. (343° C.). In carrying out the process, the hydrocarbon fraction is separated into a gas oil fraction having a boiling point between about 650° F. (343° C.) and about 1050° F. (566° C.), and a heavy residuum fraction boiling above about 1050° F. (566° C.). The gas oil fraction is catalytically hydrodesulfurized until the gas oil fraction contains less than 1 percent sulfur. The hydrodesulfurized gas oil is then used to dilute the heavy residuum fraction, and the diluted heavy residuum fraction is catalytically hydrodesulfurized, producing fuels or fuel blending components reduced in sulfur content. The process is considered to provide an increased catalyst life and to use a smaller reactor volume compared to typical processes.

U.S. Pat. No. 4,302,323 discloses a process for upgrading a residual petroleum fraction in which the residual fraction is mixed with a light cycle oil and hydrogen and the mixture sent through a catalytic hydrotreating zone containing a hydrotreating catalyst and then a hydrocracking zone containing a hydrocracking catalyst. Upgraded products are then separated from the effluent of the hydrocracking zone. The light cycle oil boils in the range of from 400° F. (204° C.) to 700° F. (371° C.), has a high aromatic content, and is high in nitrogen. It is considered that the light cycle oil acts more as a diluent rather than as a hydrogen donor and that the addition of the light cycle oil resulted in a substantial increase in the yield of premium products such as distillate fuels.

U.S. Pat. No. 4,421,633 discloses a combination hydrodesulfurization and hydrocracking process. The feedstock can be atmospheric residuum or vacuum residuum, which is mixed with a solvent that is a recycled distillate boiling at about 400° F.-700° F. (204° C.-371° C.), considered to be equivalent to a FCC light cycle oil. The process uses a mixture of large pore and small pore catalysts such as large and small pore sulfided Ni—W catalysts. The process converts the higher boiling point residua to lower boiling point hydrocarbons by forming distillate and naphtha while removing heteroatoms, metals and carbon residuals from the higher boiling point residua.

There is a need to further develop processes for hydroprocessing heavy hydrocarbon oils to produce fuel grade products. It is also particularly desirable to provide hydroprocessing processes with improved selectivity to desired products. For example, it is desirable to provide hydroprocessing processes that crack molecules boiling at or above 1050° F. (566° C.) (also referred to as a "1050° F.+(566° C.+) fraction" herein) into molecules boiling below 1050° F. (566° C.) (also referred to as a "1050° F.$^-$ (566° C.$^-$) fraction" herein), while minimizing the formation of "$C_4^-$" hydrocarbon compounds (i.e., hydrocarbon compounds having four carbons or less), and coke byproducts.

SUMMARY OF THE PREFERRED EMBODIMENTS OF THE INVENTION

This invention provides a process for producing hydroprocessed product. The hydroprocessed products are hydroprocessed hydrocarbon oils. These oils can be used to produce fuel grade products. The process provides an advantage of having a long catalyst run length. The process is also capable of saturating or partially saturating aromatic rings. The process further provides improved selectivity to desired products. In particular, the invention provides hydroprocessing processes capable of crack molecules boiling at or above 1050° F. (566° C.) into molecules boiling below 1050° F. (566° C.) (i.e., the "1050° F.$^-$ (566° C.$^-$) fraction"), while minimizing the formation of "$C_4^-$"hydrocarbon compounds (i.e., hydrocarbon compounds having four carbons or less), and coke byproducts.

According to one aspect of the invention, there is provided a process for producing a hydroprocessed product. The process includes a step of sending to a hydroprocessing zone (such zone preferably located in a reactor vessel) a combined feed comprised of a heavy hydrocarbon oil component and a solvent component. The heavy hydrocarbon oil component has an ASTM D86 10% distillation point of at least 650° F. (343° C.). The solvent component contains at least one single-ring aromatic compound. Preferably, the solvent component has an ASTM D86 10% distillation point of at least 120° C. (248° F.) and a 90% distillation point of not greater than 300° C. (572° F.).

The process further includes a step of contacting the combined feed with hydroprocessing catalyst in the presence of hydrogen. This contacting is carried out at predetermined pressure and temperature conditions to yield a hydroprocessed product.

In an alternative embodiment, the heavy hydrocarbon oil component has an initial ASTM D86 boiling point of 650° F. (343° C.) or greater. Preferably, the heavy hydrocarbon oil has an ASTM D86 10% distillation point of at least 650° F. (343° C.).

The heavy hydrocarbon oil can be high in metals, nitrogen, sulfur and asphaltene content. In one embodiment, the heavy hydrocarbon oil contains at least 0.0001 grams of Ni/V/Fe, on a total elemental basis of nickel, vanadium and iron. In another, the heavy hydrocarbon oil contains at least 50 wppm elemental nitrogen, based on total weight of the heavy hydrocarbon oil. In yet another, the heavy hydrocarbon oil contains at least 500 wppm elemental nitrogen, based on total weight of the heavy hydrocarbon oil. In still another embodiment, the heavy hydrocarbon oil contains at least 5 wt % n-pentane asphaltenes, based on total weight of the heavy hydrocarbon oil.

In a preferred embodiment, the combined feed is comprised of from 30 wt % to 95 wt % of the heavy hydrocarbon oil component and from 5 wt % to 70 wt % of the solvent component, based on total weight of the combined feed. Alternatively, the solvent is comprised of at least 50 wt % of one or more single-ring aromatic compounds.

In another embodiment, the solvent component comprises more than one single-ring aromatic compound and none of the single-ring aromatic compounds has a boiling point of greater than 550° F. (288° C.). Alternatively, the solvent component can be comprised of at least 50 wt % of one or more single ring aromatic compounds. The solvent component is a relatively low boiling point solvent that includes relatively low boiling point single ring aromatic compounds. For example, the solvent component can comprise more than one single-ring aromatic compound, with none of the single-ring aromatic compounds having a boiling point of greater than 550° F. (288° C.), preferably greater than 500° F. (260° C.), or greater than 450° F. (232° C.), or greater than 400° F. (204° C.).

The single-ring aromatic compound can optionally include one or more hydrocarbon substituents. For example, the hydrocarbon substituents can be selected from the group consisting of $C_1$-$C_6$ alkyl and $C_1$-$C_6$ alkenyl. A particular example of the single-ring aromatic compound is trimethylbenzene. For example, the solvent component can be comprised of at least 50 wt % trimethylbenzene, based on total weight of the solvent component.

The heavy hydrocarbon oil component and the solvent component can be combined prior to entering the vessel or at the vessel. The invention can also be carried out in a reaction vessel in which the vessel contains the catalyst in a fixed bed.

BRIEF DESCRIPTION OF THE DRAWINGS

The attached Figures represent alternative embodiments of the overall invention, as well as comparative examples. The Figures pertaining to the invention are intended to be viewed as exemplary embodiments within the scope of the overall invention as claimed.

DETAILED DESCRIPTION

Introduction

Figure 1:
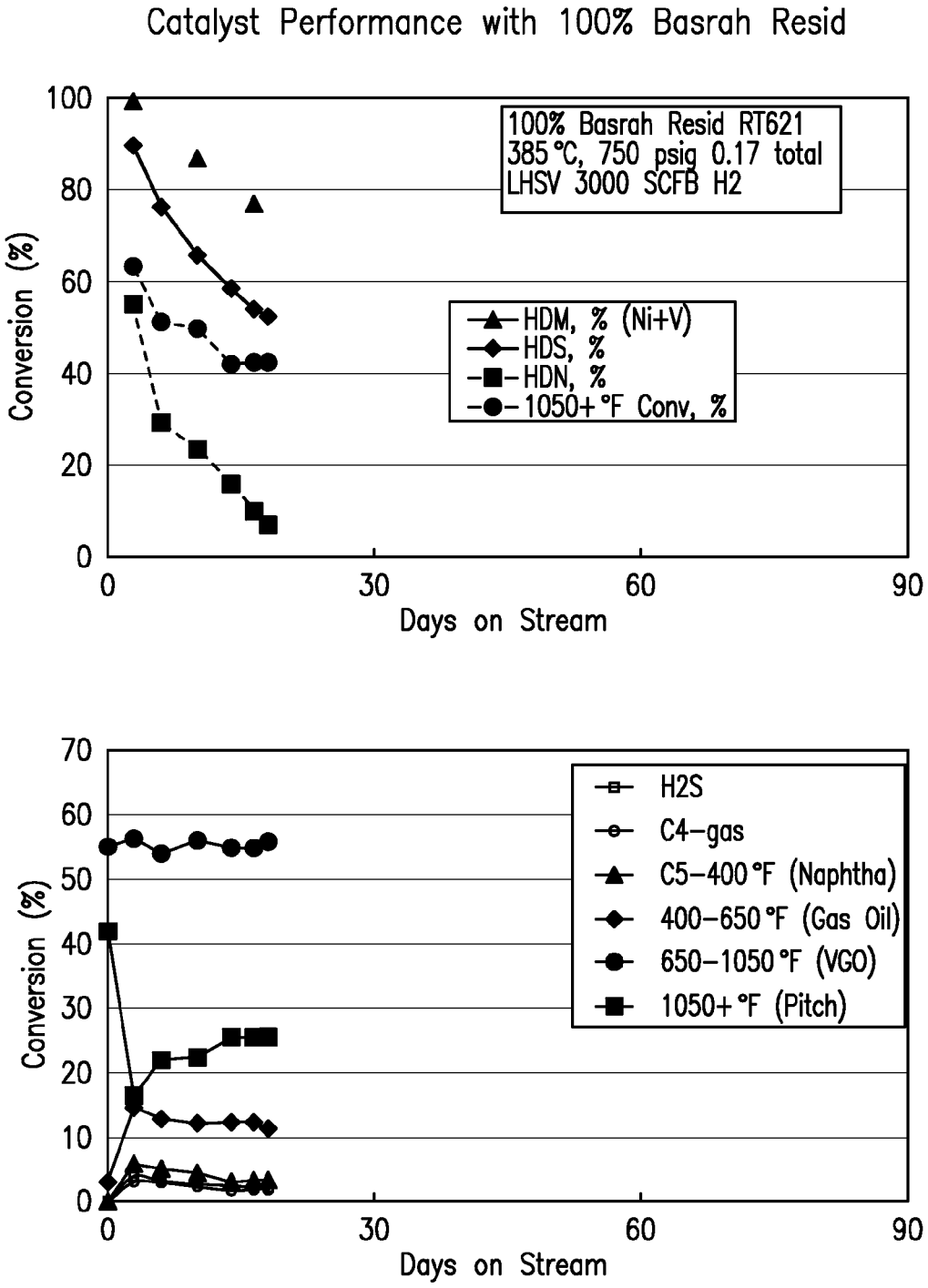
FIG. 1 shows a comparative example of hydroprocessing of 100% Basrah resid.

This invention provides a process for producing a hydroprocessed product. The process is capable of treating residua or heavy hydrocarbon oils to produce a hydroprocessed oil product that has reduced sulfur, nitrogen, metals and "1050° F.+ (566° C.+) components" (i.e., components that boil at 1050° F. (566° C.) and above) relative to the heavy oil.

The invention is particularly advantageous in that substantially longer run length can be achieved relative to conventional hydroprocessing methods. This benefit can be enhanced by operating at relatively high temperature and relatively low hydrogen partial pressure. Operation at desired temperature and pressure is carried out using a particular solvent as a co-feed component. In particular, the solvent component contains at least one single-ring aromatic compound in which the solvent used as a co-feed also has a relatively low boiling point range compared to the heavy hydrocarbon oil co-feed.

Heavy Hydrocarbon Oil

The hydroprocessed product is produced from a heavy hydrocarbon oil component. Examples of heavy hydrocarbon oils include, but are not limited to, heavy crude oils, distillation residues, heavy oils coining from catalytic treatment (such as heavy cycle oils from fluid catalytic cracking), thermal tars (such as oils from visbreaking or similar thermal processes), oils (such as bitumen) from oil sands and heavy oils derived from coal.

Heavy hydrocarbon oils can be liquid, semi-solid, and/or solid at atmospheric conditions. Additional examples of particular heavy oils that can be hydroprocessed, treated or upgraded according to this invention include Athabasca bitumen, vacuum resid from Brazilian Santos and Campos basins, Egyptian Gulf of Suez, Chad, Venezuelan Zulia, Malaysia, and Indonesia Sumatra. Other examples of heavy hydrocarbon oil include residuum from refinery distillation processes, including atmospheric and vacuum distillation processes. Such heavy hydrocarbon oils can have an initial ASTM D86 boiling point of 650° F. (343° C.) or greater. Preferably, the heavy hydrocarbon oil will have an ASTM D86 10% distillation point of at least 650° F. (343° C.), alternatively at least 660° F. (349° C.) or at least 750° F. (399° C.), or at least 1020° F. (549° C.).

Heavy hydrocarbon oils can be relatively high in total acid number (TAN). For example, heavy hydrocarbon oils that can be hydroprocessed according to this invention have a TAN of at least 0.1, at least 0.3, or at least 1.

Density, or weight per volume, of the heavy hydrocarbon can be determined according to ASTM D287-92 (2006) Standard Test Method for API Gravity of Crude Petroleum and Petroleum Products (Hydrometer Method), and is provided in terms of API gravity. In general, the higher the API gravity, the less dense the oil. API gravity is at most 20° in one embodiment, at most 15° in another embodiment, and at most 10° in another embodiment.

Heavy hydrocarbon oils can be high in metals. For example, the heavy hydrocarbon oil can be high in total nickel, vanadium and iron contents. In one embodiment, the heavy hydrocarbon oil will contain at least 0.00005grams of Ni/V/Fe (50 ppm) or at least 0.0002 grams of Ni/V/Fe (200 ppm) per gram of heavy hydrocarbon oil, on a total elemental basis of nickel, vanadium and iron.

Contaminants such as nitrogen and sulfur are found in heavy hydrocarbon oils, often in organically-bound form. Nitrogen content can range from about 50 wppm to about 5000 wppm elemental nitrogen, or about 75 wppm to about 800 wppm elemental nitrogen, or about 100 wppm to about 700 wppm, based on total weight of the heavy hydrocarbon component. The nitrogen containing compounds can be present as basic or non-basic nitrogen species. Examples of basic nitrogen species include quinolines and substituted quinolines. Examples of non-basic nitrogen species include carbazoles and substituted carbazoles.

The invention is particularly suited to treating heavy hydrocarbon oils containing at least 500 wppm elemental sulfur, based on total weight of the heavy hydrocarbon oil. Generally, the sulfur content of such heavy hydrocarbon oils can range from about 500 wppm to about 100,000 wppm elemental sulfur, or from about 1000 wppm to about 50,000 wppm, or from about 1000 wppm to about 30,000 wppm, based on total weight of the heavy hydrocarbon component. Sulfur will usually be present as organically bound sulfur. Examples of such sulfur compounds include the class of heterocyclic sulfur compounds such as thiophenes, tetrahydrothiophenes, benzothiophenes and their higher homologs and analogs Other organically bound sulfur compounds include aliphatic, naphthenic, and aromatic mercaptans, sulfides, di- and polysulfides.

Heavy hydrocarbon oils can be high in n-pentane asphaltenes. In one embodiment, the heavy hydrocarbon oil will contain at 5 wt % or at least 15 wt % n-pentane asphaltenes.

Solvent

The solvent component that is used according to this invention contains at least one single-ring aromatic ring compound, and more preferably more than one single-ring aromatic ring compound. The solvent is also a low boiling solvent relative to the heavy hydrocarbon oil. By the term "single-ring aromatic compound" as used herein, it is defined as a hydrocarbon compound containing only one cyclic ring wherein the cyclic ring is aromatic in nature.

The solvent preferably has an ASTM D86 90% distillation point of less than 300° C. (572° F.). Alternatively, the solvent has an ASTM D86 90% distillation point of less than 250° C. (482° F.) or less than 200° C. (392° F.).

In one embodiment, the solvent has an ASTM D86 10% distillation point of at least 120° C. (248° F.). Alternatively, the solvent has an ASTM D86 10% distillation point of at least 140° C. (284° F.) or at least 150° C. (302° F.).

The single-ring aromatic compound or compounds in particular have relatively low boiling points compared to the heavy hydrocarbon oil. Preferably, none of the single-ring aromatic compounds of the solvent has a boiling point of greater than 550° F. (288° C.), or greater than 500° F. (260° C.), or greater than 450° F. (232° C.), or greater than 400° F. (204° C.).

The single-ring aromatic can include one or more hydrocarbon substituents, such as from 1 to 3 or 1 to 2 hydrocarbon substituents. Such substituents can be any hydrocarbon group that is consistent with the overall solvent distillation characteristics. Examples of such hydrocarbon groups include, but are not limited to, those selected from the group consisting of $C_1$-$C_6$alkyl and $C_1$-$C_6$ alkenyl, wherein the hydrocarbon groups can be branched or linear and the hydrocarbon groups can be the same or different. A particular example of such a single-ring aromatic that includes one or more hydrocarbon substituents is trimethylbenzene (TMB).

The solvent preferably contains sufficient single-ring aromatic component(s) to effectively increase run length during hydroprocessing. For example, the solvent can be comprised of at least 50 wt % of the single-ring aromatic component, or at least 60 wt %, or at least 70 wt %, based on total weight of the solvent component.

The density of the solvent component should can also be determined according to ASTM D287-92 (2006) Standard Test Method for API Gravity of Crude Petroleum and Petroleum Products (Hydrometer Method) in terms of API gravity. API gravity of the solvent component is at most 35° in one embodiment, at most 30° in another embodiment, and at most 25° in another embodiment.

The solvent component should be combined with the heavy hydrocarbon oil component to effectively increase run length during hydroprocessing. For example, the solvent and heavy hydrocarbon component are combined so as to produce a combined feedstock that is comprised of from 30 wt % to 95 wt % of the heavy hydrocarbon oil component and from 5 wt % to 70 wt % of the solvent component, based on total weight of the combined feed. Alternatively, the solvent and heavy hydrocarbon component are combined so as to produce a combined feedstock that is comprised of from 40 wt % to 80 wt % of the heavy hydrocarbon oil component and from 10 wt % to 60 wt % of the solvent component, based on total weight of the combined feed.

The solvent can be combined with the heavy hydrocarbon oil within the hydroprocessing vessel or hydroprocessing zone. Alternatively, the solvent and heavy hydrocarbon oil can be supplied as separate streams and combined into one feed stream prior to entering the hydroprocessing vessel or hydroprocessing zone.

Hydroprocessing Catalysts

Suitable hydroprocessing catalysts for use in the present invention can include conventional hydroprocessing catalysts and particularly those that comprise at least one Group VIII non-noble metal, preferably Fe, Co, and/or Ni, such as Co and/or Ni; and at least one Group Vi metal, preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts used in the present invention can either be in bulk form or in supported form. In addition to alumina and/or silica, other suitable support/carrier materials can include, but are not limited to, zeolites, titania, silica-titania, and titania-alumina. It is within the scope of the present invention that more than one type of hydroprocessing catalyst can be used in one or multiple reaction vessels.

The at least one Group VIII non-noble metal, in oxide form, can typically be present in an amount ranging from about 2 wt % to about 30 wt %, preferably from about 4 wt % to about 15 wt %. The at least one Group VI metal, in oxide form, can typically be present in an amount ranging from about 2 wt % to about 60 wt %, preferably from about 6 wt % to about 40 wt % or from about 10 wt % to about 30 wt %. These weight percents are based on the total weight of the catalyst.

A vessel or hydroprocessing zone in which catalytic activity occurs can include one or more hydroprocessing catalysts. Such catalysts can be mixed or stacked, with the catalyst preferably being in a fixed bed in the vessel or hydroprocessing zone.

The support can be impregnated with the desired metals to form the hydroprocessing catalyst. In particular impregnation embodiments, the support is heat treated at temperatures in a range of from 400° C. to 1200° C. (752° F. to 2192° F.), or from 450° C. to 1000° C. (842° F. to 1832° F.), or from 600° C. to 900° C. (1112° F. to 1652° F.), prior to impregnation with the metals.

In an alternative embodiment, the hydroprocessing catalyst is comprised of shaped extrudates. The extrudate diameters range from $1/32^{nd}$ to $1/8^{th}$ inch, from $1/20^{th}$ to $1/10^{th}$ inch, or from $120^{th}$ to $1/16^{th}$ inch. The extrudates can be cylindrical or shaped. Non-limiting examples of extrudate shapes include trilobes and quadralobes.

The process of this invention can be effectively carried out using a hydroprocessing catalyst having any median pore diameter effective for hydroprocessing the heavy oil component. For example, the median pore diameter can be in the range of from 30 to 1000 Å (Angstroms), or 50 to 500 Å, or 60 to 300 Å. Pore diameter is preferably determined according to ASTM Method D4284-07 Mercury Porosimetry.

In a particular embodiment, the hydroprocessing catalyst has a median pore diameter in a range of from 50 to 200 Å. Alternatively, the hydroprocessing catalyst has a median pore diameter in a range of from 90 to 180 Å, or 100 to 140 Å, or 110 to 130 Å.

In another embodiment, the hydroprocessing catalyst has a median pore diameter ranging from 50 Å to 150 Å. Alternatively, the hydroprocessing catalyst has a median pore diameter in a range of from 60 Å to 135 Å, or from 70 Å to 120 Å.

The process of this invention is also effective with hydroprocessing catalysts having a larger median pore diameter. For example, the process can be effective using a hydroprocessing catalyst having a median pore diameter in a range of from 180 to 500 Å, or 200 to 300 Å, or 230 to 250 Å.

It is preferred that the hydroprocessing catalyst have a pore size distribution that is not so great as to negatively impact catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 to 180 Å, or from 60 to 150 Å, with at least 60% of the pores having a pore diameter within 45 Å, 35 Å, or 25 Åof the median pore diameter.

Pore volume should be sufficiently large to further contribute to catalyst activity or selectivity. For example, the hydroprocessing catalyst can have a pore volume of at least 0.3 $cm^3/g$, at least 0.7 $cm^3/g$, or at least 0.9 $cm^3/g$. In certain embodiments, pore volume can range from 0.3-0.99 $cm^3/g$, 0.4-0.8$cm^3/g$, or 0.5-0.7 $cm^3/g$.

In certain embodiments, the catalyst exists in shaped forms, for example, pellets, cylinders, and/or extrudates. The catalyst typically has a flat plate crush strength in a range of from 50-500 N/cm, or 60-400 N/cm, or 100-350 N/cm, or 200-300 N/cm, or 220-280 N/cm.

Hydrogen Stream

Hydroprocessing is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gases (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

Hydrogen can be supplied at a rate of from 300 SCF/B (standard cubic feet of hydrogen per barrel of feed) (53 S $m^3/m^3$) to 5000 SCF/B (891 S $m^3/m^3$). Preferably, the hydrogen is provided in a range of from 1000 SCF/B (178 S $m^3/m^3$) to 3000 SCF/B (534 S $m^3/m^3$).

Hydrogen can be supplied co-currently with the heavy hydrocarbon oil and/or solvent or separately via a separate gas conduit to the hydroprocessing zone. The contact of the heavy hydrocarbon oil and solvent with the hydroprocessing catalyst and the hydrogen produces a total product that includes a hydroprocessed oil product, and, in some embodiments, gas.

Processing Conditions

Hydroprocessing (alternatively hydroconversion) generally refers to treating or upgrading the heavy hydrocarbon oil component that contacts the hydroprocessing catalyst. Hydroprocessing particularly refers to any process that is carried out in the presence of hydrogen, including, but not limited to, hydroconversion, hydrocracking (which includes selective hydrocracking), hydrogenation, hydrotreating, hydrodesulfurization, hydrodenitrogenation, hydrodemetallation, hydrodearomatization, hydroisomerization, and hydrodewaxing including selective hydrocracking. The hydroprocessing reaction is carried out in a vessel or a hydroprocessing zone in which heavy hydrocarbon and solvent contact the hydroprocessing catalyst in the presence of hydrogen.

Contacting conditions in the contacting or hydroprocessing zone can include, but are not limited to, temperature, pressure, hydrogen flow; hydrocarbon feed flow, or combinations thereof. Contacting conditions in some embodiments are controlled to yield a product with specific properties.

Temperature in the contacting zone can range from 320° F. (160° C.) to 900° F. (482° C.), or from 350° F. (177° C.) to 800° F. (427° C.), or from 500° F. (260° C.) to 700° F. (371° C.), or from 550° F. (288° C.) to 650° F. (343° C.). In some embodiments, temperature in the contacting zone can range from 560° F. (293° C.) to 850° F. (454° C.), or 660° F. (349° C.) to 790° F. (421° C.), or 680° F. (360° C.) to 750° F. (399° C.). Total pressure in the contacting zone can range from 600 psig (4137 kPa-g) to 3000 psig (20684 kPa-g), more preferably from 650 psig (4482 kPa-g) to 2000 psig (13790 kPa-g), and most preferably from 800 psig (5516 kPa-g) to 1500 psig (10342 kPa-g).

Liquid hourly space velocity (LHSV) of the combined heavy hydrocarbon oil and solvent components will generally range from 0.1 to 30 $h^{-1}$, or 0.4 $h^{-1}$ to 2025 $h^{-1}$ or 0.5 to 1020 $h^{-1}$. In some embodiments, LHSV is at least 15 $h^{-1}$, or at least 10 $h^{-1}$, or at least 5 $h^{-1}$. Partial pressure of hydrogen in the contacting zone can range from 0.5-9, or 2-8, or 4-6 MPa, or 3-6 MPa. In some embodiments, the partial pressure of hydrogen is not greater than 7 MPa, or not greater than 6 MPa, or not greater than 5 MPa, or not greater than 4 MPa, or not greater than 3 MPa, or not greater than 2.5 MPa, or not greater than 2 MPa 550 psig (3792 kPa-g) to 3000 psig (20684 kPa-g). Preferably, the contacting of the combined feed with hydroprocessing catalyst in the presence of hydrogen is carried out at a hydrogen partial pressure of from 650 psig (4482kPa-g) to 2000 psig (13790 kPa-g), and more preferably from 800 psig (5516 kPa-g) to 1500 psig (10342-g).

Hydroprocessed Product

Relative to the heavy hydrocarbon oil component in the feedstream, the hydroprocessed product will be a material or crude product that exhibits reductions in such properties as average molecular weight, boiling point range, density amid/or concentration of sulfur, nitrogen, oxygen, and metals.

In an embodiment, contacting the heavy hydrocarbon oil and solvent with the hydroprocessing catalyst in the presence of hydrogen to produce a hydroprocessed product is carried out in a single contacting zone. In another embodiment, contacting is carried out in two or more contacting zones. The total hydroprocessed product can be separated to form one or more particularly desired liquid products and one or more gas products.

In some embodiments, the liquid product is blended with a hydrocarbon feedstock that is the same as or different from the heavy hydrocarbon oil component. For example, the liquid hydroprocessed product can be combined with a hydrocarbon oil having a different viscosity, resulting in a blended product having a viscosity that is between the viscosity of the liquid hydroprocessed product and the viscosity of the heavy hydrocarbon oil component.

In some embodiments, the hydroprocessed product and/or the blended product are transported to a refinery and distilled to produce one or more distillate fractions. The distillate fractions can be catalytically processed to produce commercial products such as transportation fuel, lubricants, or chemicals.

In some embodiments, the hydroprocessed product has a total Ni/V/Fe content of at most 50%, or at most 10%, or at most 5%, or at most 3%, or at most 1% of the total Ni/V/Fe content of the heavy hydrocarbon oil component. In certain embodiments, the fraction of the hydroprocessed product that has a boiling point of 650° F. (343° C.) and higher (i.e., 650° F.+ (343° C.+) product fraction) has, per gram of 650° F.+ (343° C.+) product fraction, a total Ni/V/Fe content in a range of from $1\times10^{-7}$ grams to $2\times10^{-4}$ grams (0.1 to 200 ppm), or $3\times10^{-7}$ to $1\times10^{-4}$ grams (0.3 to 100 ppm), or $1\times10^{-6}$ grams to $1\times10^{-4}$ grams (1 to 100 ppm). In certain embodiments, the 650° F.+ (343° C.+) product fraction has not greater than $4\times10^{-5}$ grams of Ni/V/Fe (40 ppm).

In certain embodiments, the hydroprocessed product has an API gravity that is 100-160%, or 110-140% of that of the heavy hydrocarbon oil component. In certain embodiments, API gravity of the hydroprocessed product is from 10°-40°, or 12°-35°, or 14°-30°.

In certain embodiments, the hydroprocessed product has a viscosity of at most 90%, or at most 80%, or at most 70% of that of the heavy hydrocarbon oil component. In some embodiments, the viscosity of the hydroprocessed product is at most 90% of the viscosity of the heavy hydrocarbon oil component, while the API gravity of the hydroprocessed product is 100-160%, or 105-155%, or 110-150% of that of the heavy hydrocarbon oil component.

In an alternative embodiment, the 650° F.+ (343° C.+) product fraction can have a viscosity at 100° C. of 10 to 150 cst, or 15 to 120 cst, or 20-100 cst. Most atmospheric resids of crude oils range from 40 to 200 cst. In certain embodiments, 650° F.+ (343° C.+) product fraction has a viscosity of at most 90%, or at most 50%, or at most 5% of that of the heavy hydrocarbon oil component.

In some embodiments, the hydroprocessed product has a total heteroatom (i.e., S/N/O) content of at most 50%, or at most 10%, or at most 5% of the total heteroatom content of the heavy hydrocarbon oil component.

In some embodiments, the sulfur content of the hydroprocessed product is at most 50%, or at most 10%, or at most 5% of the sulfur content of the heavy hydrocarbon feedstock The total nitrogen content of the hydroprocessed product is at most 50%, or at most 10%, or at most 5% of that of the heavy hydrocarbon feedstock, and the hydroprocessed product has a total oxygen content that is at most 75%, or at most 50%, or at most 30%, or at most 10%, or at most 5% of the total oxygen content of the heavy hydrocarbon oil component.

EXAMPLES

Example 1

A fixed bed, downflow reactor was constructed from ⅜$^{th}$ inch stainless steel tubing. Two 50 cm brass half cylinders were bolted onto the ⅜$^{th}$ inch tube. The volume of the hot zone inside the brass cylinder was 16.0 cc's. The reactor was loaded with 3 g (5.2 cc) of a supported NiMo hydroprocessing catalyst on top of 9 g (8.1 cc) of an unsupported NiMoW hydroprocessing catalyst. The supported NiMo catalyst was used primarily for removing metals from heavy oil feedstocks. The catalyst system was sulfided using a feedstock comprised of 80 wt % 130-neutral lube oil/20 wt % ethyldisulfide.

The feedstock was processed at 3000 SCF/B (standard cubic feet of hydrogen per barrel of feed), at 340° C. (644° F.), 0.2 LHSV (liquid hourly space velocity), and 1000 psig (6895 kPa) for 48 hours. The feedstock was then switched to 60 wt % Athabasca bitumen/40 wt % trimethylbenzene (TMB). Reaction conditions were changed to 800 psig (5516 kPa-g), 5 cc/hr liquid feed, and 1100 SCF/B hydrogen (197 S $m^3/m^3$). The reactor temperature was varied between 689° F.' (365° C.) and 780° F. (416° C.).

The Athabasca bitumen had the following properties: 4.8 wt % S, 5000 ppm N, 55% 450 to 1050° F. (232° C. to 566° C.), 45 wt % 1050° F.+ (566° C.+) fraction, 0.9950 specific gravity at 60° F. (15.6° C.), 67 wppm Ni, 166 wppm V, and 13 wppm Fe.

During the run, the hydrodesulfurization and hydrodmetallization levels were typically held between 60 and 70% through temperature adjustment. The deposition of metals in the reactor was tracked with time. For example, at the time that the catalyst had accumulated 5 wt % metals, the conditions were 800 psig (5516 kPa-g) and 725° F. (385° C.). Less than 1 wt % of the TMB was hydrogenated and/or hydrocracked.

The catalyst was run for 150 days. The HDS activity of the catalyst dropped by less than 1% over a 3 week period at a temperature as high as 780° F. (416° C.). The run was voluntarily terminated to enable examination of the metals distribution on the catalyst before metal loading filled any more of the catalyst void volume.

The total metal loading on the catalyst was 14 wt %. Upon ending the run, the catalysts were analyzed for vanadium profile in the extrudates. The vanadium deposit across whole extrudates was found to be evenly deposited throughout the extrudate on both catalysts, which was indicative of an insignificant presence of pore mouth plugging. Analysis of the spent catalysts showed that the metals uptake of both catalysts were similar; close to 0.14 g metal/cc of catalyst.

This example demonstrates that upgrading of Athabasca bitumen in the presence of TMB, a single-ring aromatic compound, at a moderate pressure of 800 psig (5516 kPa-g) can be achieved for an extended period of time without reactor plugging problems. Moreover, there is little metal buildup inside catalyst pores.

Examples 2-4

The feedstock and catalyst used in Examples 2-4 were a Basrah atmospheric resid and a supported Co—Mo catalyst.

The following solvents were used: trimethylbenzene (TMB) and methylnaphthalene (MN). A base-case hydroconversion experiment was done in the absence of an added solvent.

Specifically, the following four feedstocks were used in the examples:

Ex. 2: 100% Basrah resid

Ex. 3: 60% Basrah resid and 40% TMB

Ex. 4: 60% Basrah resid and 40% MN

Table 1 shows the properties of the Basrah atmospheric resid.

TABLE 1

| Feed Description | |
|---|---|
| Feed | Basrah Atmospheric Resid |
| $C_5$-400° F. | 0 |
| 400-650° F. | 3 |
| 650-1050° F. | 55 |
| 1050° F.$^+$ | 42 |
| API Gravity | 12.3 |
| S, wt % | 4.6 |
| N, wt % | 0.26 |
| Ni, wppm | 22 |
| Va, wppm | 79 |

The experiments of Examples 2-4 were carried out in an upflow fixed-bed reactor. The catalyst extrudates were crushed and screened to 40/60 mesh granules. Liquid sulfiding was carried out with ethyl disulfide dissolved in a lubricating oil at 340° C. Each experimental run was started with the standard conditions of 385° C. (725° F.), 750 psig (5171 kPa) $H_2$, 0.17 total LHSV, and 3000 SCF hydrogen/B of feed (534 S $m^3/m^3$). During the run, the loss of catalyst activity was countered by raising reactor temperature.

Example 2(Comparative)

A base case run was conducted with neat Basrah resid (i.e., 100% resid, no solvent) as described above for this Example. FIG. 1 shows the performance of the catalyst. The catalyst was on stream for 18 days with decreasing activities for 1050° F.+ (566° C.+) fraction conversion, HDM, HDS, and HDN. After 18 days, the run was forced to shut down due to excessive reactor pressure drop.

Example 3

A run was conducted with 60% Basrah resid and 40% trimethylbenzene (TMB) as described above for this Example. The reactor conditions for the first 40 days were the same as those used in Example 5. The 1050° F.+ (566° C.+) fraction conversion and HDN reached a relatively stable level after 18 days. While HDM and HDS both declined gradually, their levels were markedly higher than those shown in Example 3.

The reactor temperature was raised to 400° C. (752° F.) after 40 days and then to 425° C. (797° F.) after 62 days. The consequent increases in 1050° F.+ (566° C.+) fraction conversion, HDM, HDS, and HDM can be seen in FIG. 2. After 80 days on stream, the reactor temperature was further increased to 450° C. (842° F.). After 3 days at this temperature, the run was terminated due to reactor plugging.

Figure 2:
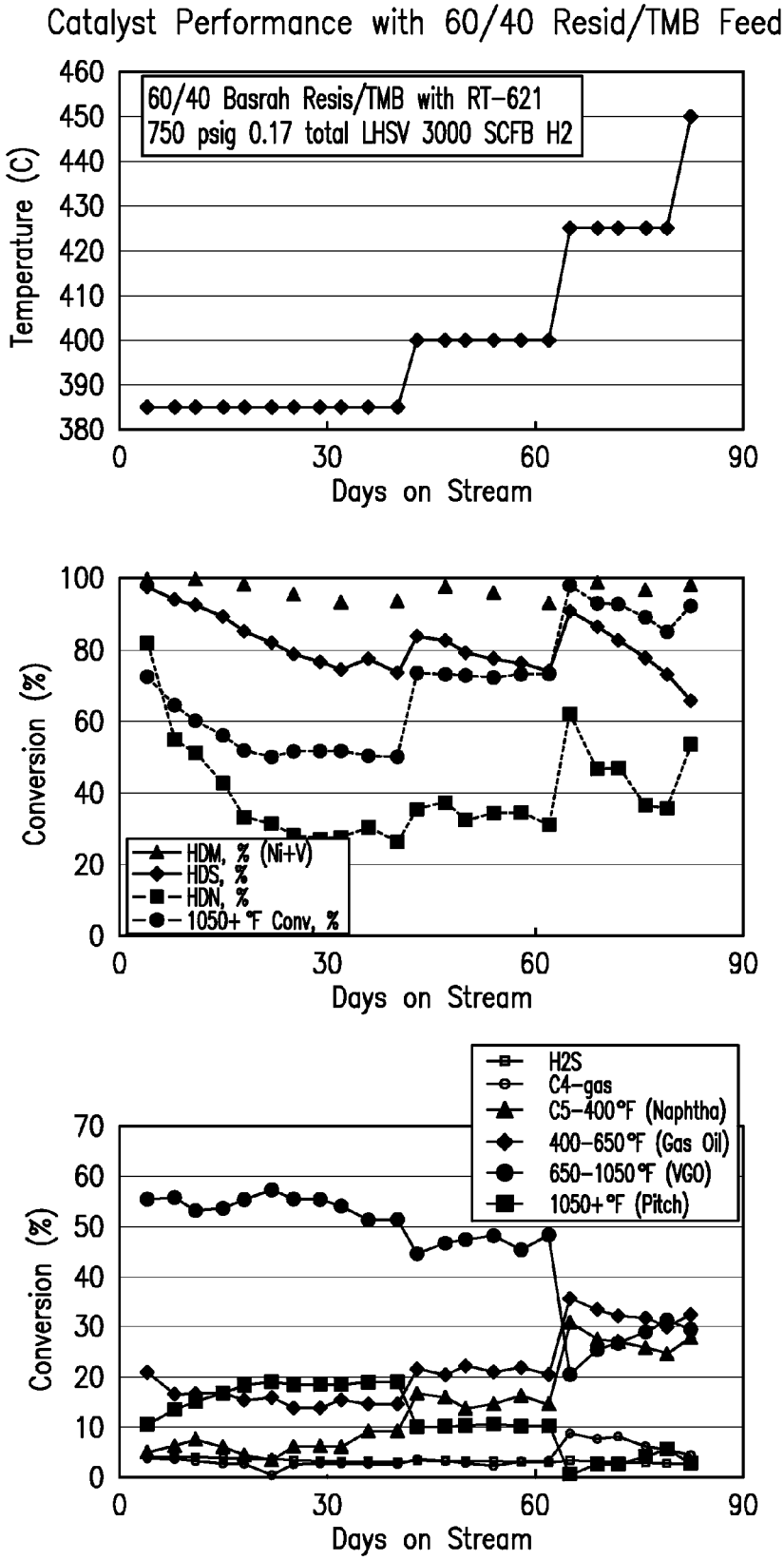
FIG. 2 shows a specific example of the invention regarding hydroprocessing of 60/40 resid/trimethylbenzene feed.

FIG. 2 also shows the catalyst performance with the 60/40 resid/TMB feed. This run was on stream for 82 days, much longer than the base case run as shown in Example 2.

The third plot in FIG. 2 further shows the quality of the liquid product is much better than that obtained from the neat resid run of Example 2. More importantly, here a far more sustainable operation can be achieved at a high 70% 1050° F.+ (566° C.+) fraction conversion and a relatively low hydrogen pressure of 750 psig (5171 kPa).

It should be noted that the hydrogenation of TMB under the reaction conditions is negligible.

In summary, the TMB-as-solvent experiment permits scanning a temperature range of 725° F. (385° C.) to 842° F.' (450° C.), whereas the no-solvent run (Example 2) was restricted to 725° F. (385° C.) due to operability problems.

Example 4(Comparative)

Figure 3:
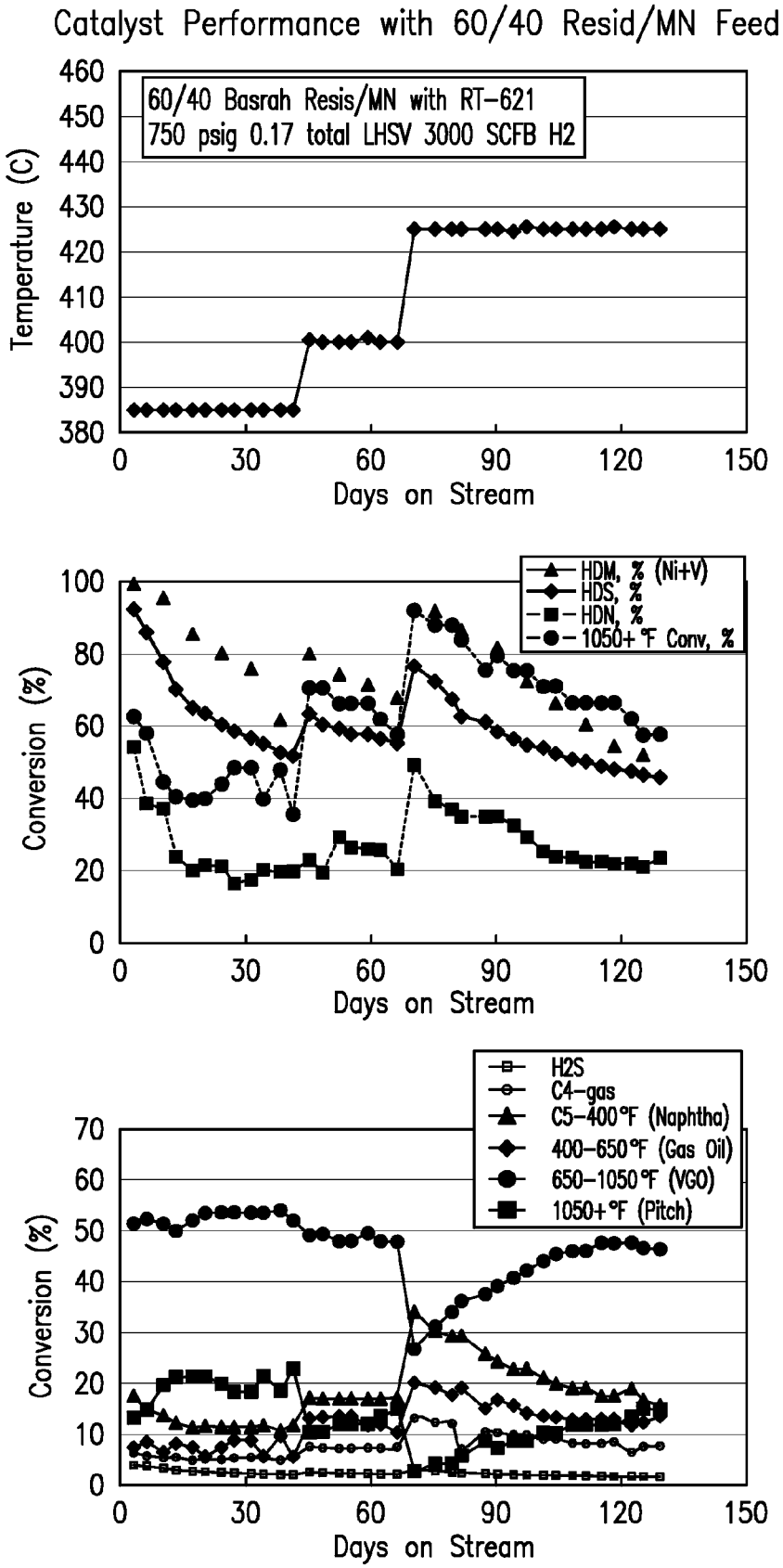
FIG. 3 shows a comparative example of hydroprocessing of 60/40 resid/methylnaphthalene feed.

This experiment was carried out using 60% Basrah resid and 40% methylnaphthalene (MN) at the same conditions as used in Example 3 for the first 42 days. FIG. 3 shows the performance data of this Example. As seen from FIG. 3, the reaction temperature was increased from 725° F. (385° C.) to 752° F. (400° C.) after 42 days on stream and to 797° F. (425° C.) after 66 days.

The catalyst performances in terms of 1050° F.+ (566° C.+) fraction conversion, HDM, HDS, and HDN were inferior to those observed with the 40% TMB case. This indicates that MN solvent is less effective than TMB.

Specifically, the performance difference between TMB and MN in terms of product quality is compared at a constant resid throughput (space time yield) of 103 g resid processed per g of catalyst. As can seen from Table 2, the 40% TMB run gives a superior product quality in terms of 1050° F.+ (566° C.+) fraction conversion, HDM, HDS, and HDN. Also, the yield is lower. Note also that the TMB-as-solvent experiment permits scanning a temperature range of 725° F. to 842° F. (385-450° C.), whereas the no-solvent run (Example 2) was restricted to 725° F. (385° C.) due to operability problem.

TABLE 2

| Performance Comparison at a Constant Resid Throughput | | | |
|---|---|---|---|
| | 100% Resid | 60/40 Resid/TMB | 60/40 Resid/MN |
| Feed, wt % | | | |
| Resid processed/cat, g/g | 103 | 102 | 103 |
| (Stream time) | (18 days) | (32 days) | (32 days) |
| 1050° F.$^+$ Conversion, % | 42 | 52 | 48 |
| HDM, % | 75 | 93 | 79 |
| HDS, % | 52 | 75 | 57 |
| HDN, % | 7 | 28 | 18 |
| Product Distribution, wt % | | | |
| $H_2S$ | 2.1 | 3.2 | 2.3 |
| $C_4^-$ gas | 1.9 | 2.8 | 5.5 |
| $C_5$-400° F. (naphtha) | 3.3 | 6.1 | 11.5 |
| 400-650° F. (distillate) | 11.4 | 15.4 | 8.8 |
| 650-1050° F. (gas oil) | 55.8 | 54.0 | 53.6 |
| 1050° F.$^+$ | 25.5 | 18.5 | 18.4 |
| Sum | 100 | 100 | 100 |

The foregoing results show that the presence of a low boiling aromatic solvent leads to increased catalyst activity in terms of product quality and reactor operability. Compared to hydroprocessing without a solvent (Example 2) or a higher boiling solvent (Example 4), substantial improvement was observed with the lower boiling solvent illustrated in Example 3. Due to the presence of a low boiling aromatic solvent, the most preferred hydrogen pressure used in the present invention is much lower than those employed in conventional residual or heavy oil hydroprocessing processes.

The boiling points of the described lower boiling aromatics useful according to this invention are much lower than those of heavy oils and resids. The presence of such low boiling aromatic solvents improves the product quality (Example 4) and reactor operability (Example 1) of the hydroprocessing process.

Conventional resid and heavy oil hydroprocessing processes cannot be effectively operated at the hydrogen pressure ranges specified in the present invention clue to reactor plugging problems and excessive coke formation. The presence of the appropriate low boiling aromatic solvent mitigates plugging of the catalyst bed and hence increases overall catalyst productivity.

Instead of feeding the appropriate light aromatic solvent from the reactor inlet, part of the solvent may be fed to the reactor via interbed quench zones. This would allow the solvent to help control reaction exothermicity (adiabatic temperature rise) and improve the liquid flow distribution in the reactor bed. The use of the appropriate light aromatic solvent has the additional benefit because of relatively straightforward separation and solvent recycle.

The principles and modes of operation of this invention have been described above with reference to various exemplary and preferred embodiments. As understood by those of skill in the art, the overall invention, as defined by the claims, encompasses other preferred embodiments not specifically enumerated herein.

The invention claimed is:

1. A process for producing a hydroprocessed product, comprising: sending to a hydroprocessing zone a combined feed comprised of a heavy hydrocarbon oil component, wherein the heavy hydrocarbon oil component has a 10% distillation point of at least 650° F. (343° C.), and a solvent component containing at least one single ring aromatic compound in which the solvent has an ASTM D86 10% distillation point of at least 120° C. (248° F.) and a 90% distillation point of not greater than 300° C. (572° F.), the solvent component comprising at least 50 wt% trimethylbenzene based on a total weight of the solvent component; and contacting the combined feed with a hydroprocessing catalyst in the presence of hydrogen in the hydroprocessing zone to form a hydroprocessed product.

2. The process of claim 1, wherein the heavy hydrocarbon oil component has an initial boiling point of at least 650° F. (343° C.).

3. The process of claim 1, wherein the heavy hydrocarbon oil component contains at least 0.0001 grams of Ni/V/Fe, on a total elemental basis of nickel, vanadium and iron.

4. The process of claim 1, wherein the heavy hydrocarbon oil component contains at least 50 wppm elemental nitrogen, based on total weight of the heavy hydrocarbon oil component.

5. The process of claim 4, wherein the heavy hydrocarbon oil component contains at least 500 wppm elemental sulfur, based on total weight of the heavy hydrocarbon oil component.

6. The process of claim 1, wherein the heavy hydrocarbon oil component contains at least 5 wt % n-pentane asphaltenes, based on total weight of the heavy hydrocarbon oil component.

7. The process of claim 1, wherein the combined feed is comprised of from 30 wt % to 95 wt % of the heavy hydrocarbon oil component and from 5 wt % to 70 wt % of the solvent component, based on total weight of the combined feed.

8. The process of claim 1, wherein the solvent component comprises more than one single-ring aromatic compound and none of the single-ring aromatic compounds has a boiling point of greater than 550° F. (288° C.).

9. The process of claim 8, wherein none of the single-ring aromatic compounds has a boiling point of greater than 400° F. (204° C.).

10. The process of claim 1, wherein the solvent component comprises more than one single-ring aromatic compound, and none of the single-ring aromatic compounds has a boiling point of greater than 550° F. (288° C.).

11. The process of claim 1, wherein the heavy hydrocarbon oil component and the solvent component are combined prior to entering the hydroprocessing zone.

12. The process of claim 1, wherein the hydroprocessing zone contains the hydroprocessing catalyst in a fixed bed.

13. The process of claim 12, wherein the conditions in the hydroprocessing zone include a temperature of from 350° F. (177° C.) to 800° F. (427° C.), a total pressure of from 800 psig (5516 kPa-g) to 1500 psig (10342 kPa-g), and a liquid hourly space velocity (LHSV) of the combined heavy hydrocarbon oil and solvent components of from 0.1 to 30 $h^{-1}$.

14. The process of claim 1, wherein the solvent component is trimethylbenzene.

* * * * *